US011658441B2

(12) United States Patent
Li et al.

(10) Patent No.: US 11,658,441 B2
(45) Date of Patent: May 23, 2023

(54) CABLE CONNECTOR WITH IMPROVED SHIELDING PERFORMANCE

(71) Applicant: LUXSHARE PRECISION INDUSTRY CO., LTD., Shenzhen (CN)

(72) Inventors: Huabing Li, Shenzhen (CN); Zhongyuan Lai, Shenzhen (CN); Chenhui Zeng, Shenzhen (CN); Yu Huang, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 27 days.

(21) Appl. No.: 17/476,884

(22) Filed: Sep. 16, 2021

(65) Prior Publication Data

US 2022/0123510 A1 Apr. 21, 2022

(30) Foreign Application Priority Data

Oct. 19, 2020 (CN) ..... 202011120990.4
Nov. 24, 2020 (CN) ..... 202011335045.6

(51) Int. Cl.
*H01R 13/6592* (2011.01)
*H01R 13/405* (2006.01)
(Continued)

(52) U.S. Cl.
CPC ..... *H01R 13/6592* (2013.01); *H01R 13/405* (2013.01); *H01R 13/6581* (2013.01); *H01R 13/6597* (2013.01)

(58) Field of Classification Search
CPC ..... H01R 13/6581; H01R 13/6592; H01R 13/6597; H01R 13/405
(Continued)

(56) References Cited

U.S. PATENT DOCUMENTS

D517,016 S 3/2006 Nishio et al.
D521,937 S 5/2006 Nishio et al.
(Continued)

FOREIGN PATENT DOCUMENTS

CN 201285892 Y 8/2009
CN 102025072 A * 4/2011
(Continued)

OTHER PUBLICATIONS

"5 Pcs HDMI Mate 19 Pins A Type Solder Plug Termination Repair Replace" SHOPEE, 2021, pp. 1-4, https://www.newark.com/multicomp/60s019p-301 n-b1/connector-hdmi-plug-19-position/dp/06R5630.

(Continued)

*Primary Examiner* — Peter G Leigh
(74) *Attorney, Agent, or Firm* — Birch, Stewart, Kolasch & Birch, LLP

(57) ABSTRACT

An electrical connector includes an insulating body and a terminal module. The terminal module includes a first terminal module, a second terminal module, and a shielding piece. The first terminal module includes a number of first conductive terminals. Each first conductive terminal includes a first elastic contact arm and a first tail portion. The second terminal module includes a number of second conductive terminals. Each second conductive terminal includes a second elastic contact arm and a second tail portion. The shielding piece includes a connecting portion and a number of ground terminals. The ground terminals include a number of first ground elastic arms arranged in a same row as the first elastic contact arms and a number of second ground elastic arms arranged in a same row as the second elastic contact arms. As a result, the shielding performance of the electrical connector is improved.

20 Claims, 20 Drawing Sheets

(51) Int. Cl.
*H01R 13/6581* (2011.01)
*H01R 13/6597* (2011.01)

(58) Field of Classification Search
USPC ..... 439/607.41
See application file for complete search history.

(56) References Cited

U.S. PATENT DOCUMENTS

| | | | | |
|---|---|---|---|---|
| D521,938 | S | 5/2006 | Nishio et al. | |
| D525,589 | S | 7/2006 | Wu | |
| 7,497,724 | B1 * | 3/2009 | Fong | H01R 13/665 439/497 |
| D680,500 | S | 4/2013 | Xie et al. | |
| D688,651 | S | 8/2013 | Daniel | |
| D710,366 | S | 8/2014 | Kim | |
| D774,035 | S | 12/2016 | Kao | |
| 9,590,360 | B2 * | 3/2017 | Chuang | H01R 13/627 |
| 9,705,241 | B2 * | 7/2017 | Wu | H01R 13/5845 |
| 9,837,740 | B2 | 12/2017 | Liao | |
| 9,859,659 | B2 * | 1/2018 | Resendez | H01R 13/514 |
| D835,109 | S | 12/2018 | Chen | |
| 10,333,263 | B2 * | 6/2019 | Wu | H01R 24/64 |
| 10,348,010 | B2 * | 7/2019 | Wu | H01R 12/778 |
| 10,498,089 | B2 * | 12/2019 | Li | H01R 13/6589 |
| 10,547,147 | B2 | 1/2020 | Taniguchi | |
| D959,428 | S | 8/2022 | Bockenstedt et al. | |
| D960,169 | S | 8/2022 | Liu | |
| 2013/0109242 | A1 | 5/2013 | Li et al. | |
| 2013/0115822 | A1 | 5/2013 | Pan et al. | |
| 2015/0288107 | A1 * | 10/2015 | Wu | H01R 13/6593 439/357 |
| 2016/0254621 | A1 * | 9/2016 | Wu | H01R 13/6593 439/607.47 |
| 2017/0338586 | A1 * | 11/2017 | Wang | H01R 13/5219 |
| 2018/0040969 | A1 * | 2/2018 | Wu | H01R 12/596 |
| 2018/0254587 | A1 * | 9/2018 | Zhao | H01R 13/516 |
| 2018/0375232 | A1 * | 12/2018 | Wu | H01R 13/6593 |
| 2019/0267764 | A1 * | 8/2019 | Wu | H01R 13/502 |
| 2020/0014158 | A1 | 1/2020 | Chien et al. | |
| 2020/0244012 | A1 * | 7/2020 | Hsu | H01R 13/6593 |
| 2021/0119374 | A1 | 4/2021 | Wan et al. | |
| 2022/0123510 | A1 | 4/2022 | Li et al. | |

FOREIGN PATENT DOCUMENTS

| | | | | |
|---|---|---|---|---|
| CN | 202134700 U | * | 2/2012 | |
| CN | 202513383 U | * | 10/2012 | H01R 12/61 |
| CN | 104348008 A | * | 2/2015 | H01R 13/02 |
| CN | 204179377 U | * | 2/2015 | |
| CN | 204441547 U | | 7/2015 | |
| CN | 104868321 A | * | 8/2015 | H01R 12/71 |
| CN | 204651522 U | | 9/2015 | |
| CN | 106911026 A | * | 6/2017 | H01R 13/405 |
| CN | 206271989 U | | 6/2017 | |
| CN | 107181090 A | | 9/2017 | |
| CN | 107359451 A | * | 11/2017 | H01R 13/405 |
| CN | 107871987 A | * | 4/2018 | H01R 12/58 |
| CN | 108808312 A | * | 11/2018 | |
| CN | 109390803 A | * | 2/2019 | H01R 13/02 |
| CN | 109390809 A | * | 2/2019 | H01R 12/724 |
| CN | 109787000 A | * | 5/2019 | H01R 12/72 |
| CN | 110364868 A | * | 10/2019 | |
| CN | 110518412 A | * | 11/2019 | |
| CN | 109301544 B | * | 9/2020 | H01R 12/722 |
| TW | M493185 U | | 1/2015 | |
| TW | 202021210 A | * | 6/2020 | |

OTHER PUBLICATIONS

Multicomp Pro, "60S019-301N-B1—Multicomp Pro—HDMI Connector, Mini, 19 Contacts", Newark, 2020 (available online Nov. 18, 2020), pp. 1-2 (3 pages total), https://www.newark.com/multicomp/60s019p-301 n-b1/connector-hdmi-plug-19-position/dp/06R5630.

Oiyagai. "Oiyagai 5pcs HDMI Male Gold Plated 19 Pin Repair Plug Soldering Wire Type Connectors". Amazon, 2018 (available online May 5, 2018), pp. 1-9, https://www.amazon.com/Oiyagai-Plated-Repair-Soidering-Connectors/dp/B07CYJYL24/.

U.S. Office Action for U.S. Appl. No. 29/776,430, dated Jul. 13, 2022.

U.S. Office Action for U.S. Appl. No. 29/776,430, dated Oct. 21, 2022.

* cited by examiner

CABLE CONNECTOR WITH IMPROVED SHIELDING PERFORMANCE

CROSS-REFERENCE TO RELATED APPLICATIONS

This patent application claims priority of a Chinese Patent Application No. 202011120990.4, filed on Oct. 19, 2020 and titled "ELECTRICAL CONNECTOR", and a Chinese Patent Application No. 202011335045.6, filed on Nov. 24, 2020 and titled "ELECTRICAL CONNECTOR", the entire content of which is incorporated herein by reference.

TECHNICAL FIELD

The present disclosure relates to a cable connector, which belongs to a technical field of connectors.

BACKGROUND

With the continuous improvement of data transmission quality requirements of electrical connectors, how to reduce the interference problem of conductive terminals during data transmission is a technical problem that needs to be solved by those skilled in the art.

In addition, in some cable connectors, the conductive terminals need to be connected with the cables, i.e., through soldering. As the density of conductive terminals of electrical connectors continues to increase, how to improve soldering efficiency while ensuring soldering quality is also a technical problem that needs to be solved by those skilled in the art.

SUMMARY

An object of the present disclosure is to provide a cable connector with better shielding performance.

In order to achieve the above object, the present disclosure adopts the following technical solution: an electrical connector, including: an insulating body, the insulating body including a mating surface, a mating slot extending through the mating surface, a mounting surface opposite to the mating surface, and an installation space extending through the mounting surface; a terminal module, the terminal module being at least partially installed in the insulating body; and a first shielding shell, the first shielding shell enclosing the insulating body; wherein the terminal module includes a first terminal module, a second terminal module, and a shielding piece at least partially clamped between the first terminal module and the second terminal module; wherein the first terminal module includes a first insulating block and a plurality of first conductive terminals fixed to the first insulating block, each first conductive terminal includes a first elastic contact arm extending into the mating slot and a first tail portion disposed opposite to the first elastic contact arm; wherein the second terminal module includes a second insulating block and a plurality of second conductive terminals fixed to the second insulating block, each second conductive terminal includes a second elastic contact arm extending into the mating slot and a second tail portion disposed opposite to the second elastic contact arm; and wherein the shielding piece includes a connecting portion between the plurality of first conductive terminals and the plurality of second conductive terminals, and a plurality of ground terminals extending from the connecting portion; the ground terminals include a plurality of first ground elastic arms arranged in a same row as the first elastic contact arms and a plurality of second ground elastic arms arranged in a same row as the second elastic contact arms.

Compared with the prior art, the present disclosure includes the shielding piece at least partially sandwiched between the first terminal module and the second terminal module. The shielding piece includes the connecting portion and the plurality of ground terminals extending from the connecting portion. The plurality of ground terminals include the first ground elastic arms arranged in the same row as the first elastic contact arms and the second ground elastic arms arranged in the same row as the second elastic contact arms. As a result, it reduces the mutual interference of data transmission between the first conductive terminals and the second conductive terminals, thereby improving the shielding performance of the electrical connector.

DETAILED DESCRIPTION

Figure 1:
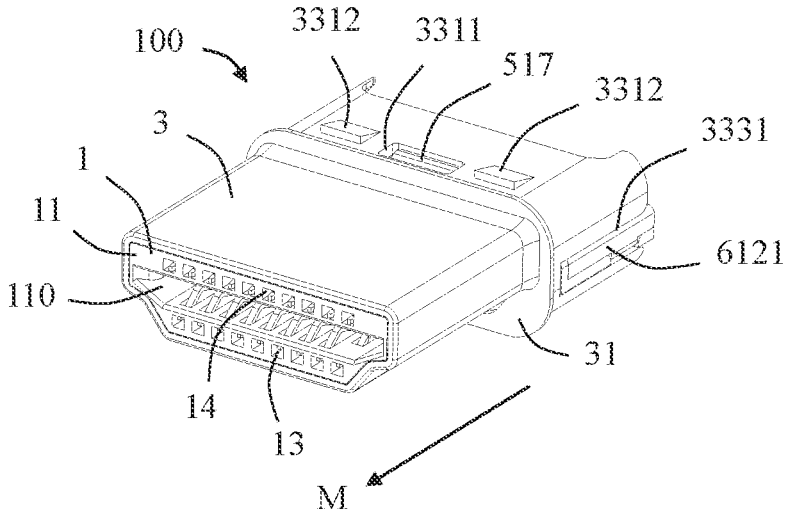
FIG. 1 is a perspective schematic view of an electrical connector in accordance with an embodiment of the present disclosure.
Figure 2:
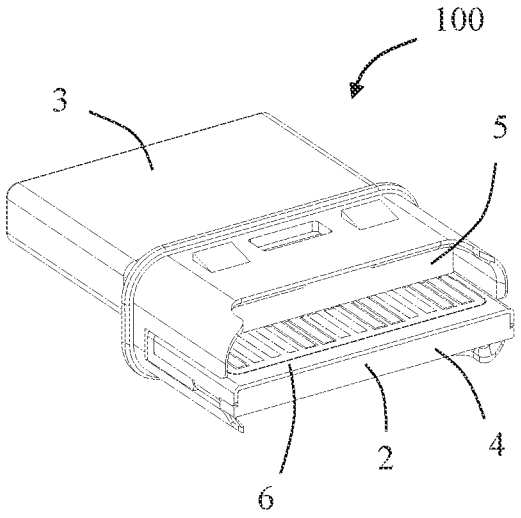
FIG. 2 is a perspective schematic view of FIG. 1 from another angle.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Referring to FIGS. 1 to 12, the present disclosure discloses an electrical connector 100 including an insulating body 1, a terminal module 2 at least partially installed in the insulating body 1 and a first shielding shell 3 enclosing the insulating body 1. In the illustrated embodiment of the present disclosure, the electrical connector 100 is an HDMI connector. The electrical connector 100 is adapted to connect with a plurality of cables 200. The electrical connector 100 is adapted to mate with a mating connector (not shown) along a mating direction M so as to realize data transmission. Of course, it is understandable to those skilled in the art that in other embodiments, the electrical connector 100 may also be another type of the electrical connector.

Figure 10:
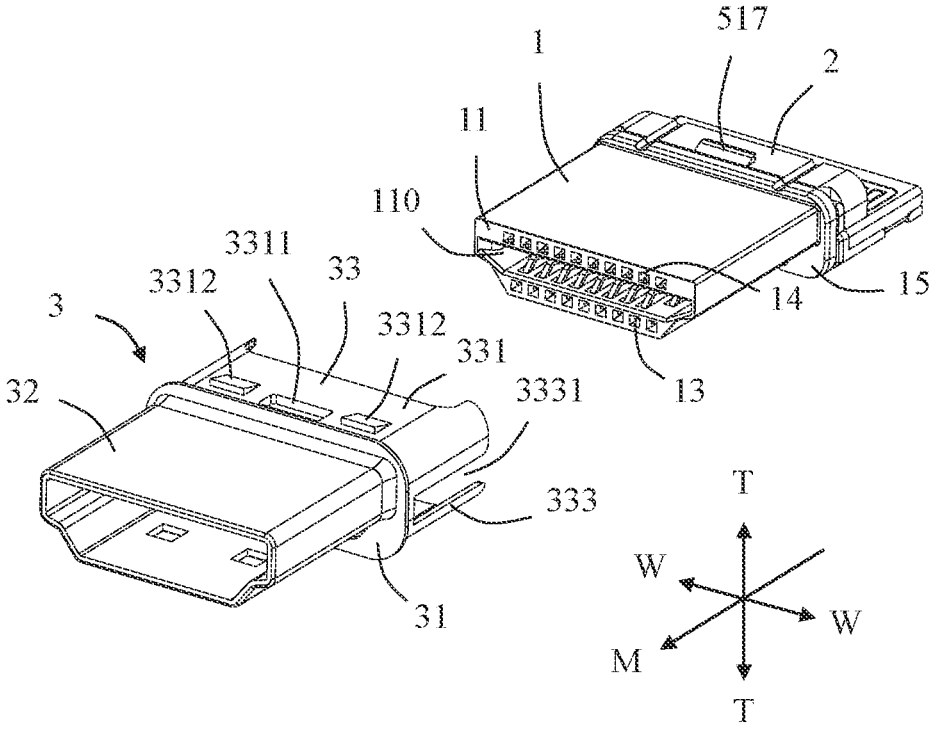
FIG. 10 is a partially exploded perspective view of FIG. 1.
Figure 11:
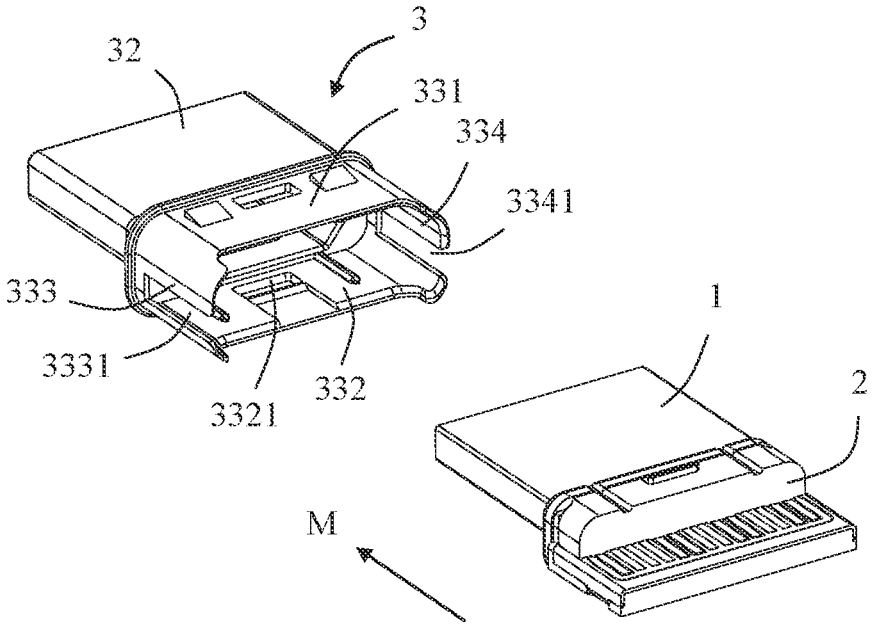
FIG. 11 is a partially exploded perspective view of FIG. 10 from another angle.

Referring to FIGS. 7 to 12, in the illustrated embodiment of the present disclosure, the first shielding shell 3 has a one-piece structure made of a metal material. The first shielding shell 3 includes a flange portion 31, a mating portion 32 extending from the flange portion 31 in the mating direction M, and a retaining portion 33 extending from the flange portion 31 in a direction opposite to the mating direction M. In the illustrated embodiment of the present disclosure, the mating portion 32 has an appearance and size that comply with the HDMI standard. The flange portion 31 protrudes from the mating portion 32 to an outer periphery so as to be able to play a limiting role and prevent the mating portion 32 from being excessively inserted into the mating connector. The retaining portion 33 includes a top wall 331, a bottom wall 332 opposite to the top wall 331, a first side wall portion 333 which connects the top wall 331 and the bottom wall 332 and is located on one side, and a second side wall portion 334 which connects the top wall 331 and the bottom wall 332 and located on the other side. The bottom wall 332 includes a first locking hole 3321 and a plurality of first protrusions 3322 located on both sides of the first locking hole 3321 (referring to FIGS. 11 and 7). The top wall 331 includes a second locking hole 3311 and a plurality of second protrusions 3312 located on both sides of the second locking hole 3311 (referring to FIG. 10). Both the first locking hole 3321 and the second locking hole 3311 are adapted to lock the terminal module 2 so as to prevent the terminal module 2 from being separated from the first shielding shell 3. An upper concept of the first protrusion 3322 and/or the second protrusion 3312 is a protrusion. Referring to FIG. 11, the first side wall portion 333 includes a first notch 3331 extending through the retaining portion 33 in a direction opposite to the mating direction M. The second side wall portion 334 includes a second notch 3341 extending through the retaining portion 33 in a direction opposite to the mating direction M.

Figure 3:
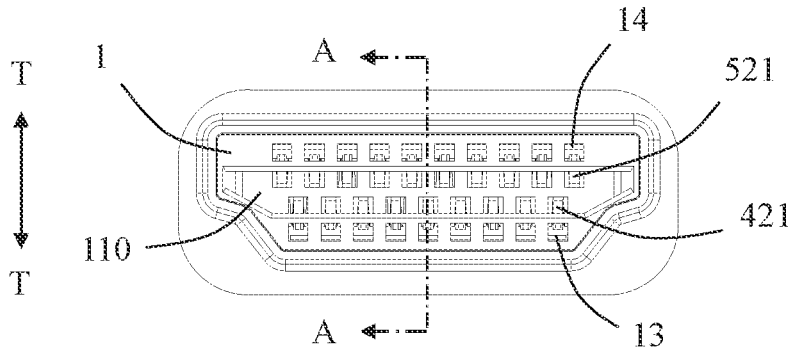
FIG. 3 is a front view of FIG. 1.
Figure 4:
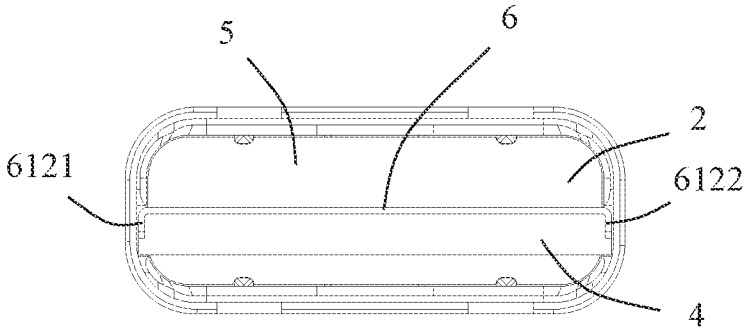
FIG. 4 is a rear view of FIG. 1.
Figure 5:
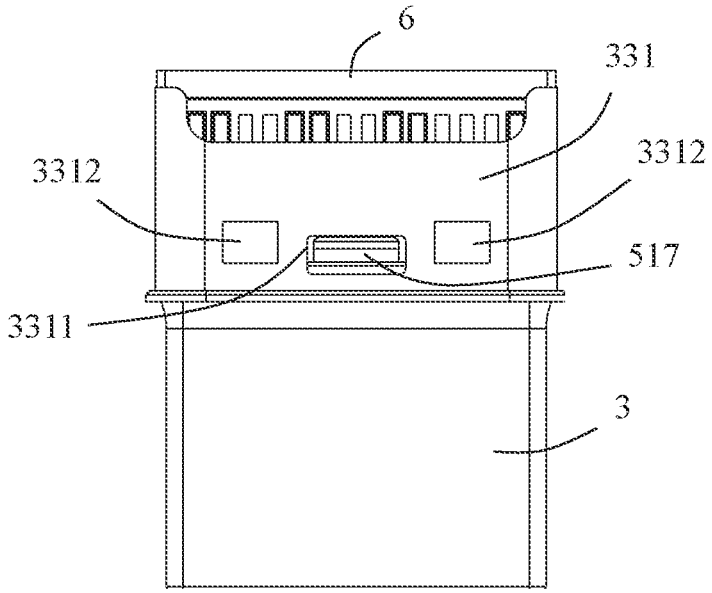
FIG. 5 is a left side view of FIG. 1.
Figure 6:
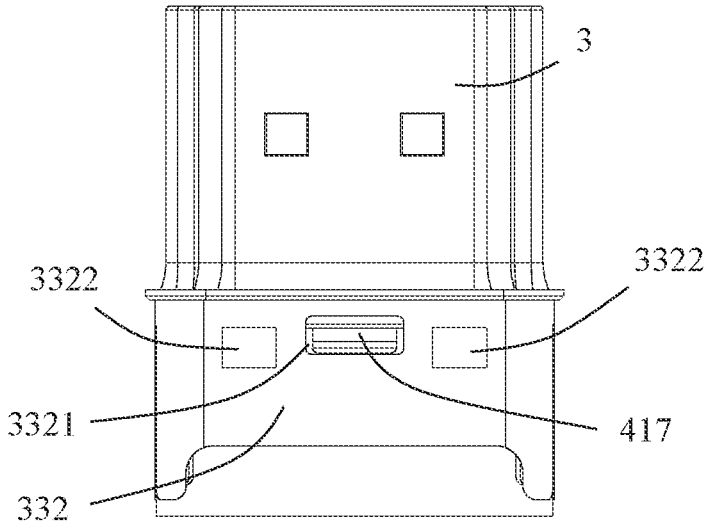
FIG. 6 is a right side view of FIG. 1.
Figure 7:
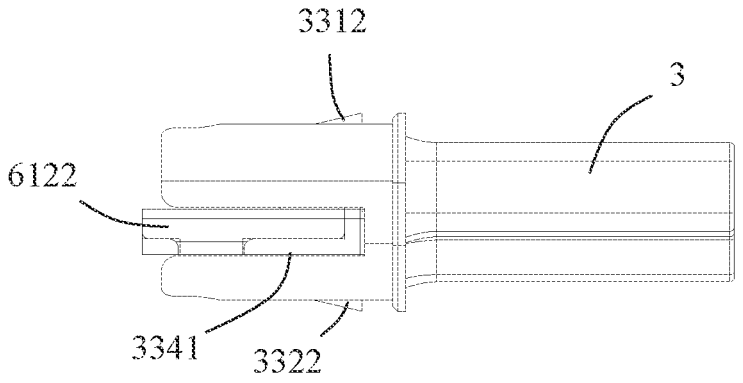
FIG. 7 is a top view of FIG. 1.
Figure 8:
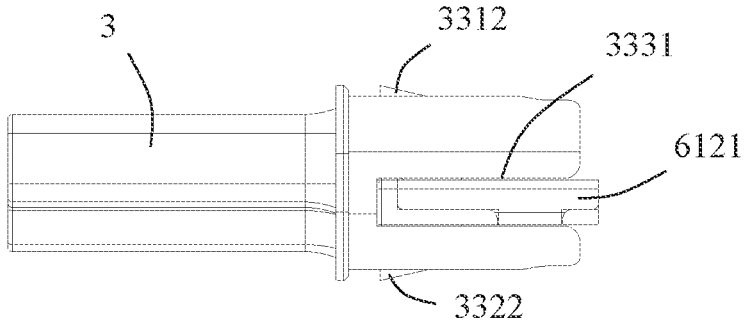
FIG. 8 is a bottom view of FIG. 1.
Figure 9:
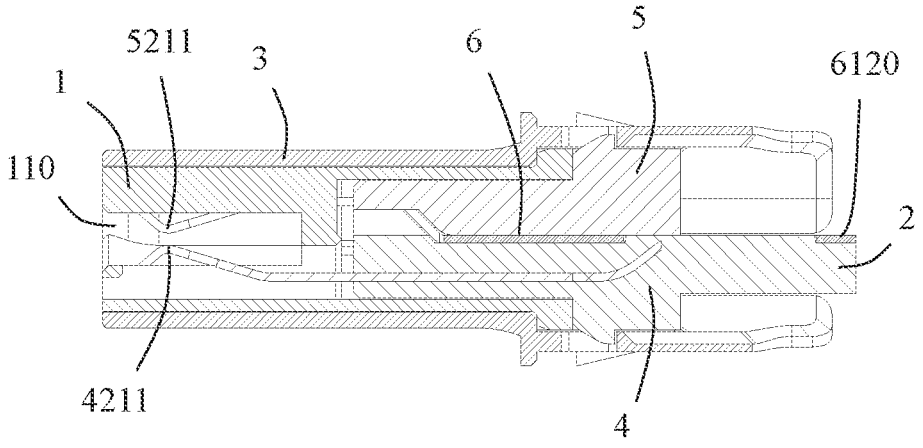
FIG. 9 is a schematic cross-sectional view taken along line A-A in FIG. 3.
Figure 12:
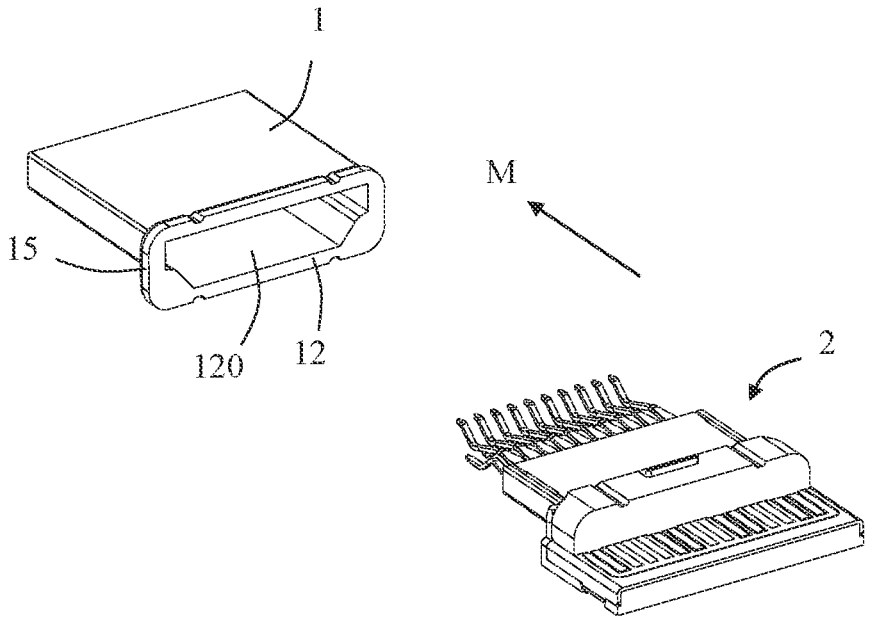
FIG. 12 is an exploded perspective view of a terminal module and an insulating body in FIG. 11.

Referring to FIGS. 10 and 12, the insulating body 1 includes a mating surface 11, a mating slot 110 extending through the mating surface 11, a mounting surface 12 opposite to the mating surface 11 and an installation space 120 extending through the mounting surface 12. The terminal module 2 is installed in the installation space 120 along the mating direction M from the mounting surface 12. The insulating body 1 extends along its thickness direction T-T (i.e., a top-bottom direction) and a width direction W-W (i.e., a left-right direction). In addition, the insulating body 1 further includes a plurality of first terminal receiving slots 13 communicating with the mating slot 110, and a plurality of second terminal receiving slots 14 communicated with the mating slot 110. In the illustrated embodiment of the present disclosure, the first terminal receiving slots 13 and the second terminal receiving slots 14 are respectively located on opposite sides (i.e., a lower side and an upper side) of the mating slot 110 along the thickness direction T-T of the insulating body 1. The first terminal receiving slots 13 and the second terminal receiving slots 14 are staggered along the thickness direction T-T of the insulating body 1 (as shown in FIG. 3). In the illustrated embodiment of the present disclosure, the first terminal receiving slots 13 and the second terminal receiving slots 14 further extend through the mating surface 11 along the mating direction M. With this arrangement, on one hand, the first terminal receiving slots 13 and the second terminal receiving slots 14 can be designed to be longer, thereby facilitating the installation of the terminal module 2; on the other hand, it can provide better heat dissipation to the conductive terminals of the terminal module 2.

Referring to FIG. 10, in the illustrated embodiment of the present disclosure, the insulating body 1 further includes a protruding portion 15 adjacent to the mounting surface 12 and arranged around. On one hand, the protruding portion 15 can play a limiting role when the insulating body 1 is mated with the first shielding shell 3; on the other hand, the protruding portion 15 can also play a limiting role when the terminal module 2 is mated with the insulating body 1.

Figure 13:
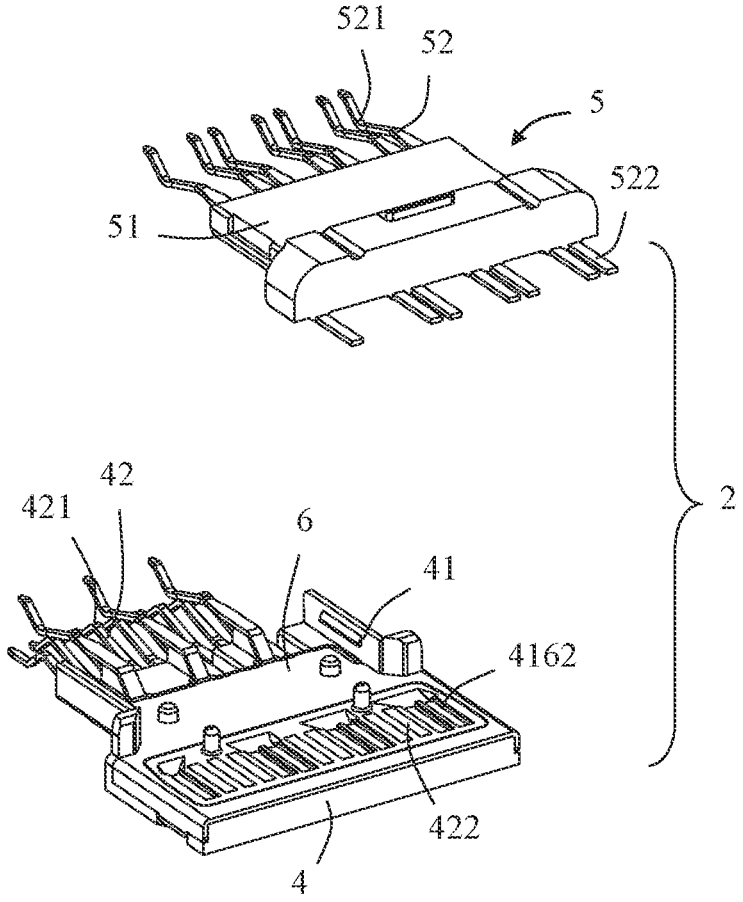
FIG. 13 is a partial perspective exploded view of the terminal module in FIG. 12.
Figure 14:
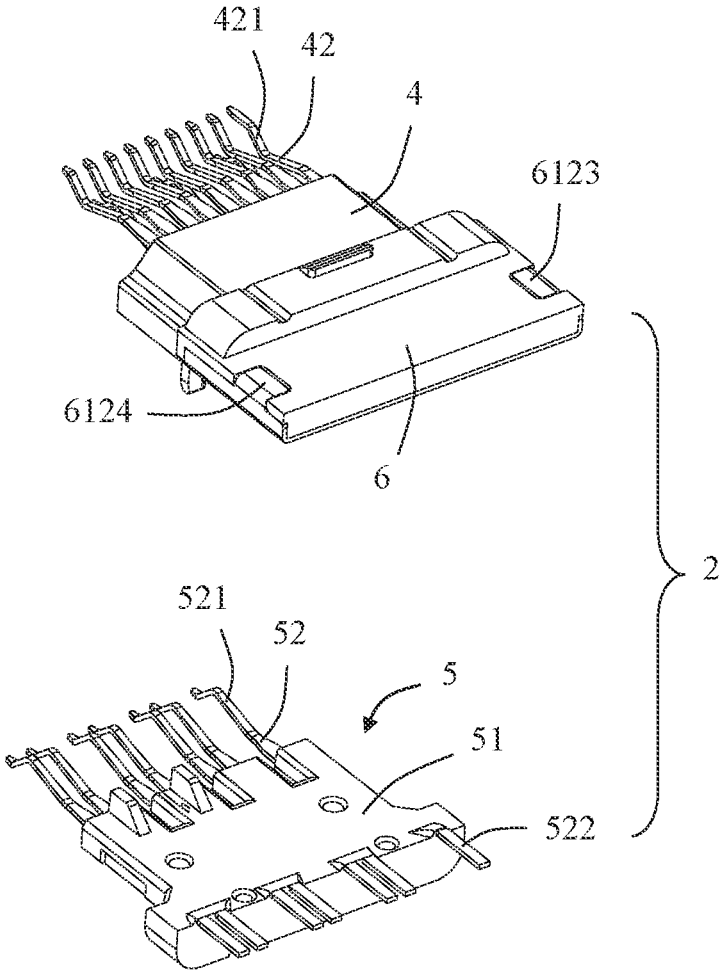
FIG. 14 is a partially exploded perspective view of FIG. 13 from another angle.

Referring to FIGS. 12 to 14, the terminal module 2 includes a first terminal module 4, a second terminal module 5, and a shielding piece 6 is at least partially clamped between the first terminal module 4 and the second terminal module 5.

Figure 15:
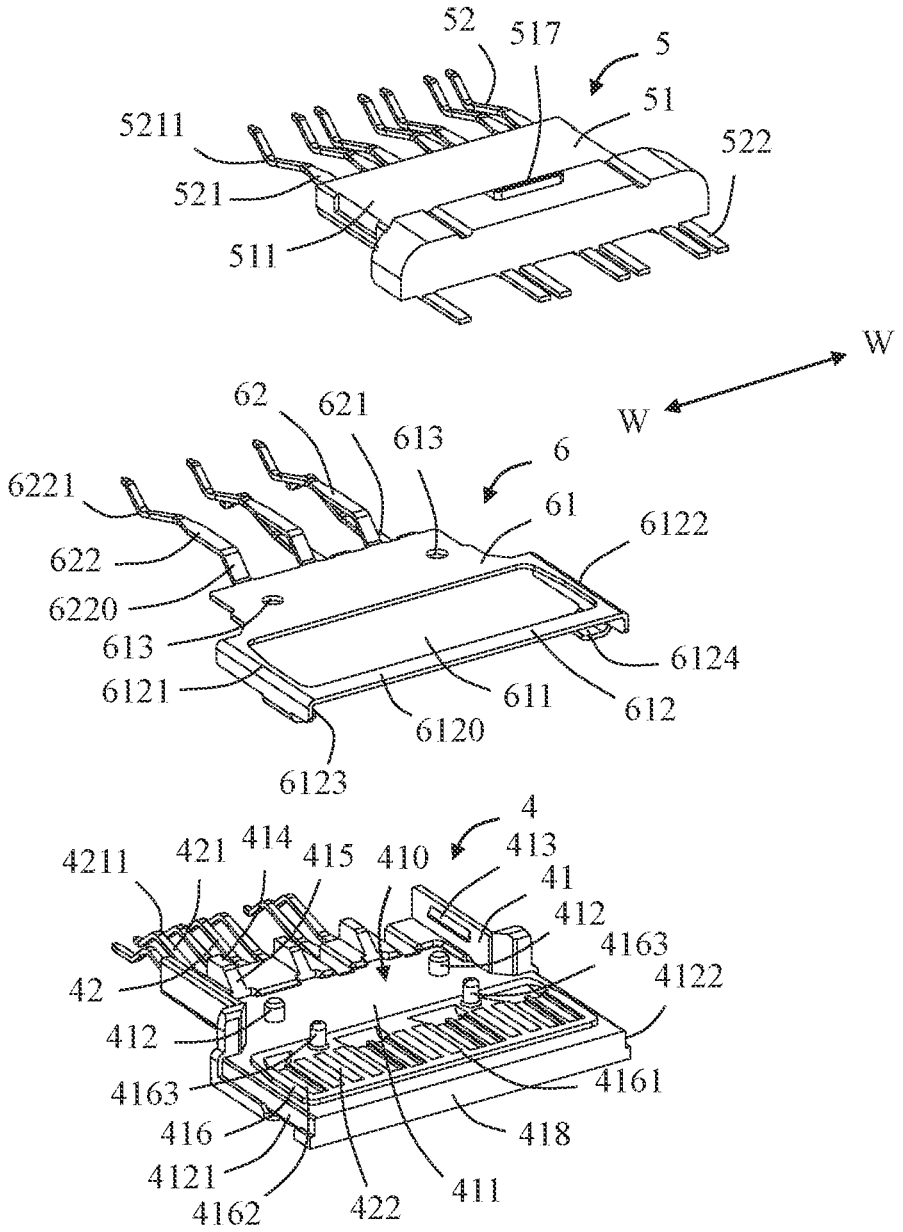
FIG. 15 is a further perspective exploded view of FIG. 13.
Figure 16:
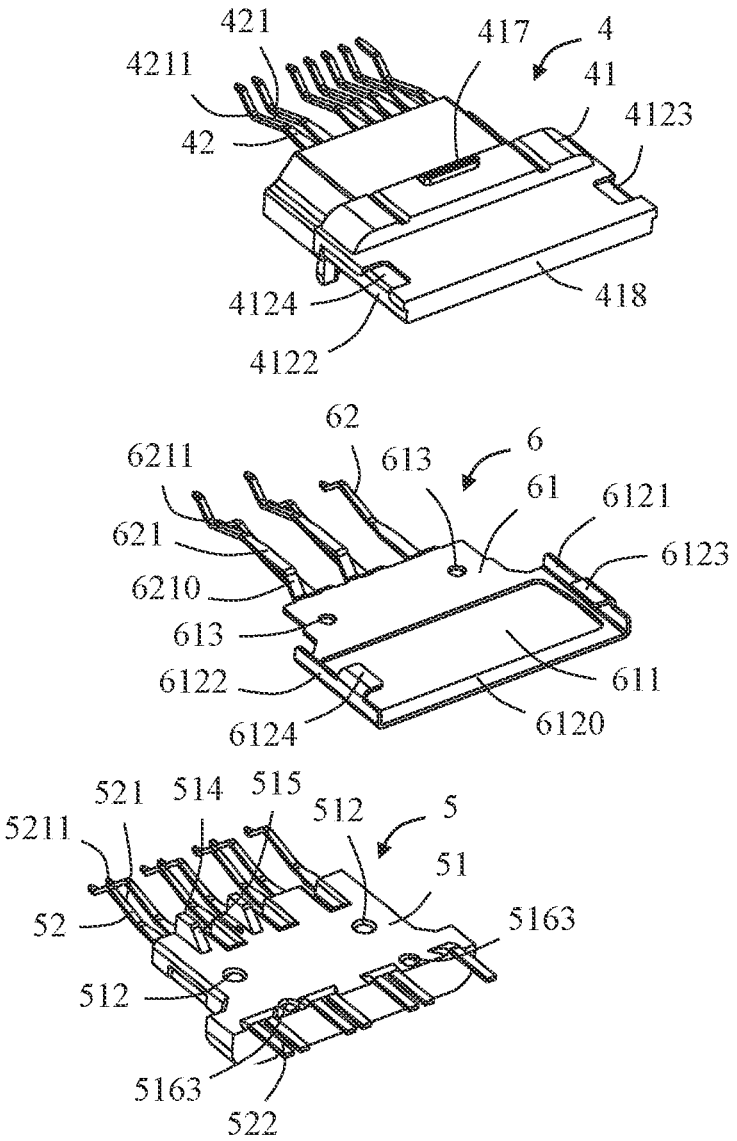
FIG. 16 is a further perspective exploded view of FIG. 14.

Referring to FIGS. 15 and 16, the first terminal module 4 includes a first insulating block 41 and a plurality of first conductive terminals 42 fixed to the first insulating block 41. In the illustrated embodiment of the present disclosure, the plurality of first conductive terminals 42 are insert-molded with the first insulating block 41. Of course, in other embodiments, the plurality of first conductive terminals 42 may also be fixed to the first insulating block 41 by assembling. Similarly, the second terminal module 5 includes a second insulating block 51 and a plurality of second conductive terminals 52 fixed to the second insulating block 51. In the illustrated embodiment of the present disclosure, the plurality of second conductive terminals 52 are insert-molded with the second insulating block 51. Of course, in other embodiments, the plurality of second conductive terminals 52 may also be fixed to the second insulating block 51 by assembling.

The first insulating block 41 includes a first base 411 and an extension 418 extending backwardly from the first base 411. The first base 411 includes a receiving space 410 for receiving the second insulating block 51, a plurality of first positioning posts 412 protruding into the receiving space 410 and a plurality of first ribs 413 protruding into the receiving space 410. Referring to FIG. 15, the first insulating block 41 further includes a first supporting protrusion 414. The first supporting protrusion 414 includes a first supporting inclined surface 415.

The extension 418 includes a raised platform 416. The raised platform 416 includes an assembly surface 4161 and a plurality of receiving grooves 4162 recessed from the assembly surface 4161. In addition, the raised platform 416 also includes a plurality of second positioning posts 4163 extending toward the second insulating block 51. The extension 418 includes a first recessed portion 4121 and a second recessed portion 4122 on both sides thereof. The extension 418 further includes a first recess 4123 connected to the first recessed portion 4121, and a second recess 4124 connected to the second recessed portion 4122. The first recess 4123 and the second recess 4124 are located on opposite sides of the extension 418 from the assembly surface 4161. The first recessed portion 4121, the second recessed portion 4122, the first recess 4123 and the second recess 4124 are all used to mate with the shielding piece 6. The first insulating block 41 further includes a first locking protrusion 417 located on the same surface as the first recess 4123 and the second recess 4124. The first locking protrusion 417 is adapted to be locked in the first locking hole 3321.

The first conductive terminal 42 includes a first elastic contact arm 421 extending beyond the first insulating block 41 and a first tail portion 422 disposed opposite to the first elastic contact arm 421. The first elastic contact arm 421 has a cantilever shape and extends into the mating slot 110. The first elastic contact arm 421 includes a first contact portion 4211 for electrically connecting with the mating connector.

The second insulating block 51 includes a second base 511. The second base 511 is received in the receiving space 410 of the first insulating block 41. Two sides of the second base 511 interfere with the first rib 413 respectively, so as to improve the holding force therebetween and prevent loosening. The second base 511 includes a plurality of first positioning holes 512 mating with the first positioning posts 412 and a plurality of second positioning holes 5163 mating with the second positioning posts 4163. Referring to FIG. 16, the second insulating block 51 further includes a second supporting protrusion 514. The second supporting protrusion 514 includes a second supporting inclined surface 515. The second insulating block 51 further includes a second locking protrusion 517. The second locking protrusion 517 is adapted to be locked in the second locking hole 3311.

The second conductive terminal 52 includes a second elastic contact arm 521 extending beyond the second insulating block 51 and a second tail portion 522 disposed opposite to the second elastic contact arm 521. The second elastic contact arm 521 has a cantilever shape and extends into the mating slot 110. The second elastic contact arm 521 includes a second contact portion 5211 for electrically connecting with the mating connector. The first contact portion 4211 and the second contact portion 5211 extend toward the middle. That is, the first contact portion 4211 protrudes toward the second contact portion 5211, and the second contact portion 5211 protrudes toward the first contact portion 4211. With this arrangement, the first contact portion 4211 and the second contact portion 5211 can jointly clamp a tongue plate (not shown) of the mating connector. The second tail portion 522 extends beyond the second insulating block 51 in a direction opposite to the mating direction M.

In the illustrated embodiment of the present disclosure, the shielding piece 6 is made of a metal material and has a one-piece structure. The shielding piece 6 includes a connecting portion 61 located between the plurality of first conductive terminals 42 and the plurality of second conductive terminals 52, and a plurality of ground terminals 62 extending from the connecting portion 61. The connecting portion 61 includes an opening 611, a frame 612 surrounding the opening 611, and a plurality of mounting holes 613 for mating with the first positioning posts 412. The frame 612 includes a first side wall 6121, a second side wall 6122 parallel to the first side wall 6121, and a transverse wall 6120 connecting the first side wall 6121 and the second side wall 6122. The first side wall 6121 is located in the first notch 3331 and is electrically connected with the first shielding shell 3. The second side wall 6122 is located in the second notch 3341 and is electrically connected with the first shielding shell 3. With this arrangement, the shielding piece 6 and the first shielding shell 3 can be connected as a whole, thereby increasing the grounding area and improving the shielding effect. In an embodiment of the present disclosure, the first side wall 6121 is interference-fitted in the first notch 3331 so as to be electrically connected with the first shielding shell 3. The second side wall 6122 is interference-fitted in the second notch 3341 so as to be electrically connected with the first shielding shell 3. With this arrangement, the soldering step can be omitted through interference fit. In addition, the shielding piece 6 further includes a first tab portion 6123 extending from the first side wall 6121 and a second tab portion 6124 extending from the second side wall 6122. The first tab portion 6123 and the second tab portion 6124 are used to mate with the first recess 4123 and the second recess 4124, respectively, so as to more reliably fix the shielding piece 6 on the first insulating block 41.

Figure 17:
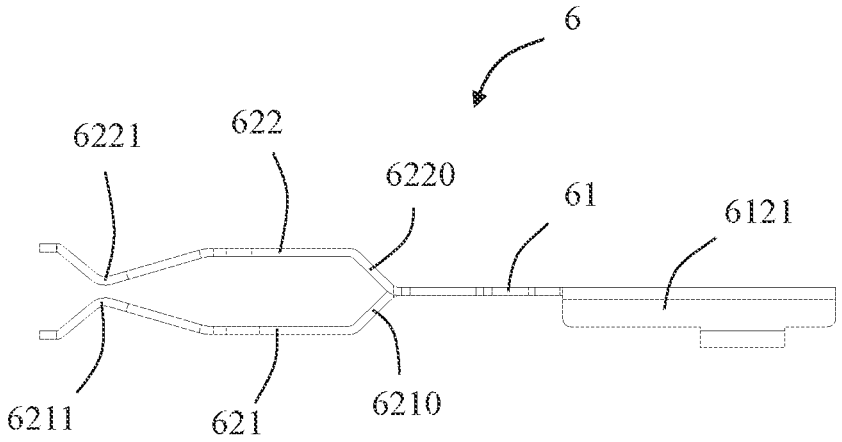
FIG. 17 is a left side view of the shielding piece in FIG. 15.

The plurality of ground terminals 62 include a plurality of first ground elastic arms 621 arranged in a same row as the first elastic contact arms 421, and a plurality of second ground elastic arms 622 arranged in a same row as the second elastic contact arms 521. The first ground elastic arm 621 includes a first contacting portion 6211 and a first inclined root portion 6210 connected to the connecting portion 61. The first inclined root portion 6210 is supported on the second supporting inclined surface 515. The second ground elastic arm 622 includes a second contacting portion 6221 and a second inclined root portion 6220 connected to the connecting portion 61. The second inclined root portion 6220 is supported on the first supporting inclined surface 415. Such a configuration can provide better root support for the first ground elastic arms 621 and the second ground elastic arms 622, thereby helping to improve reliability. In the illustrated embodiment of the present disclosure, the first ground elastic arms 621 and the second ground elastic arms 622 are arranged along the width direction W-W of the insulating body 1. Inclined directions of the first ground elastic arms 621 and the second ground elastic arms 622 are different (referring to FIG. 17).

The first insulating block 41 and the second insulating block 51 include locking structures that cooperate with each other so that at least a part of the connecting portion 61 can be clamped between the first insulating block 41 and the second insulating block 51. In the illustrated embodiment of the present disclosure, the locking structures include, but is not limited to, the first positioning posts 412 and the first positioning holes 512, and the second positioning posts 4163 and the second positioning holes 5163.

Steps of assembling the terminal module 2 of the present disclosure are as follows: firstly, the first conductive terminals 42 are insert-molded with the first insulating block 41 so as to form the first terminal module 4; and the second conductive terminals 52 are insert-molded with the second insulating block 51 so as to form the second terminal module 5; secondly, the shielding piece 6 is mounted on the first terminal module 4, in which the mounting holes 613 of the connecting portion 61 is sleeved on the first positioning posts 412, and the first side wall 6121 and the second side wall 6122 are retained in the first recessed portion 4121 and the second recessed portion 4122, respectively. Then, the first tab portion 6123 and the second tab portion 6124 are bent so that they are retained in the first recess 4123 and the second recess 4124, respectively. At this time, the opening 611 is sleeved on the raised platform 416. Finally, the first terminal module 4 and the second terminal module 5 are assembled together as a whole. At this time, the connecting portion 61 is located between the first insulating block 41 and the second insulating block 51 along the thickness direction T-T of the insulating body 1. The frame 612 is located at a periphery of the first tail portions 422 and the second tail portions 522. That is, the first tail portions 422 and the second tail portions 522 are in the opening 611 and not in contact with the frame 612. The first tail portions 422 and the second tail portions 522 are exposed on the assembly surface 4161.

In the illustrated embodiment of the present disclosure, none of the plurality of first conductive terminals 42 and the plurality of second conductive terminals 52 includes a terminal with grounding function. The terminals having the grounding function (i.e., the ground terminals 62) are all formed on the shielding piece 6.

Figure 18:
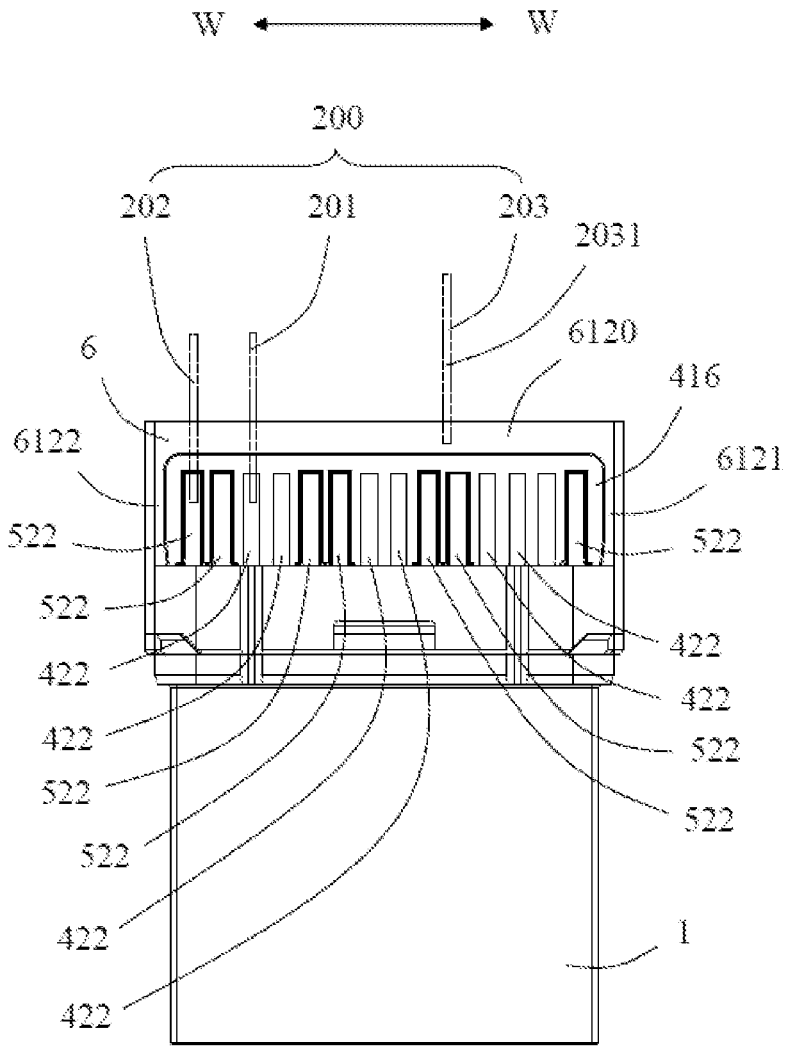
FIG. 18 is a top view of the terminal module and the insulating body in FIG. 11 when they are installed together.
Figure 19:
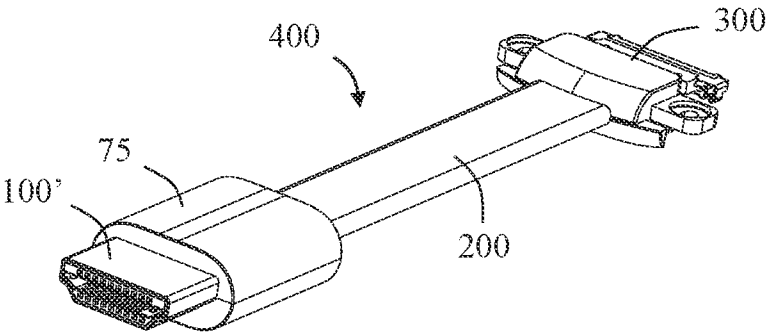
FIG. 19 is a perspective schematic view of a cable connector in accordance with an embodiment of the present disclosure.
Figure 20:
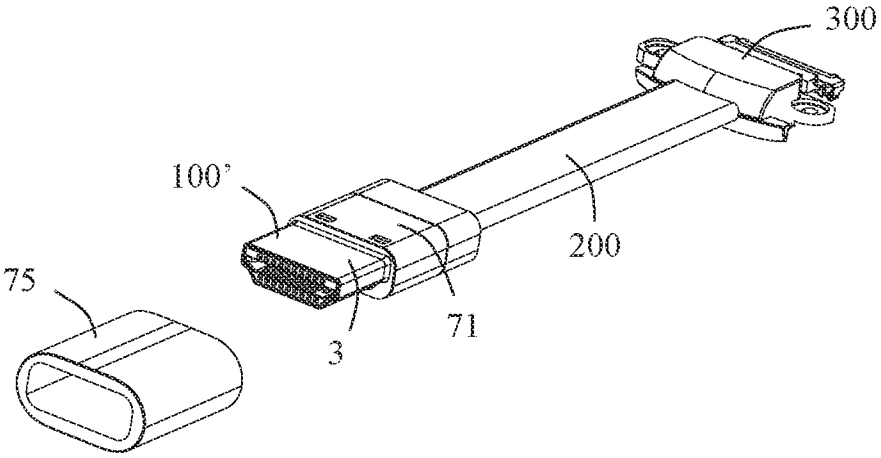
FIG. 20 is a partially exploded perspective view of FIG. 19.
Figure 21:
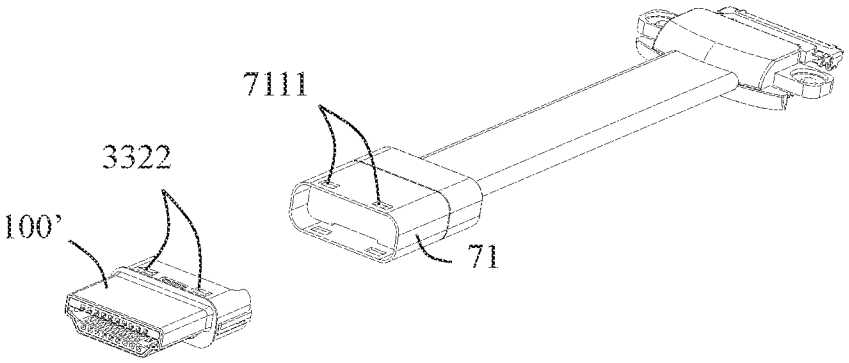
FIG. 21 is a further perspective exploded view after removing an outer housing in FIG. 19.
Figure 22:
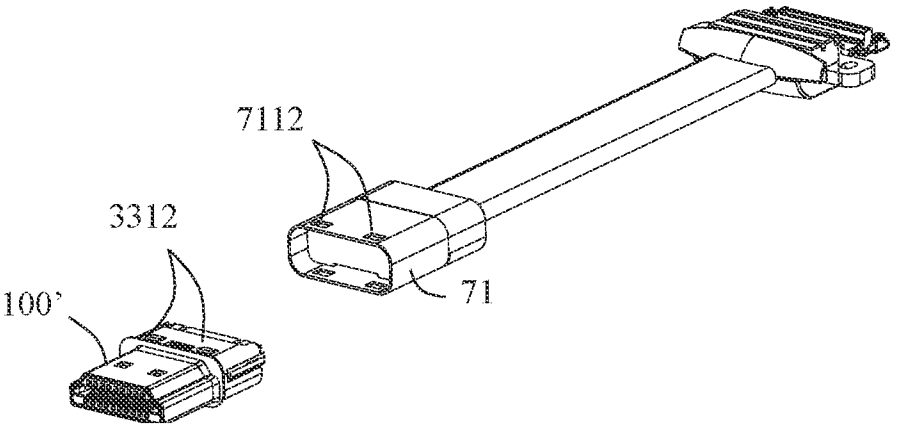
FIG. 22 is a partially exploded perspective view of FIG. 21 from another angle.
Figure 23:
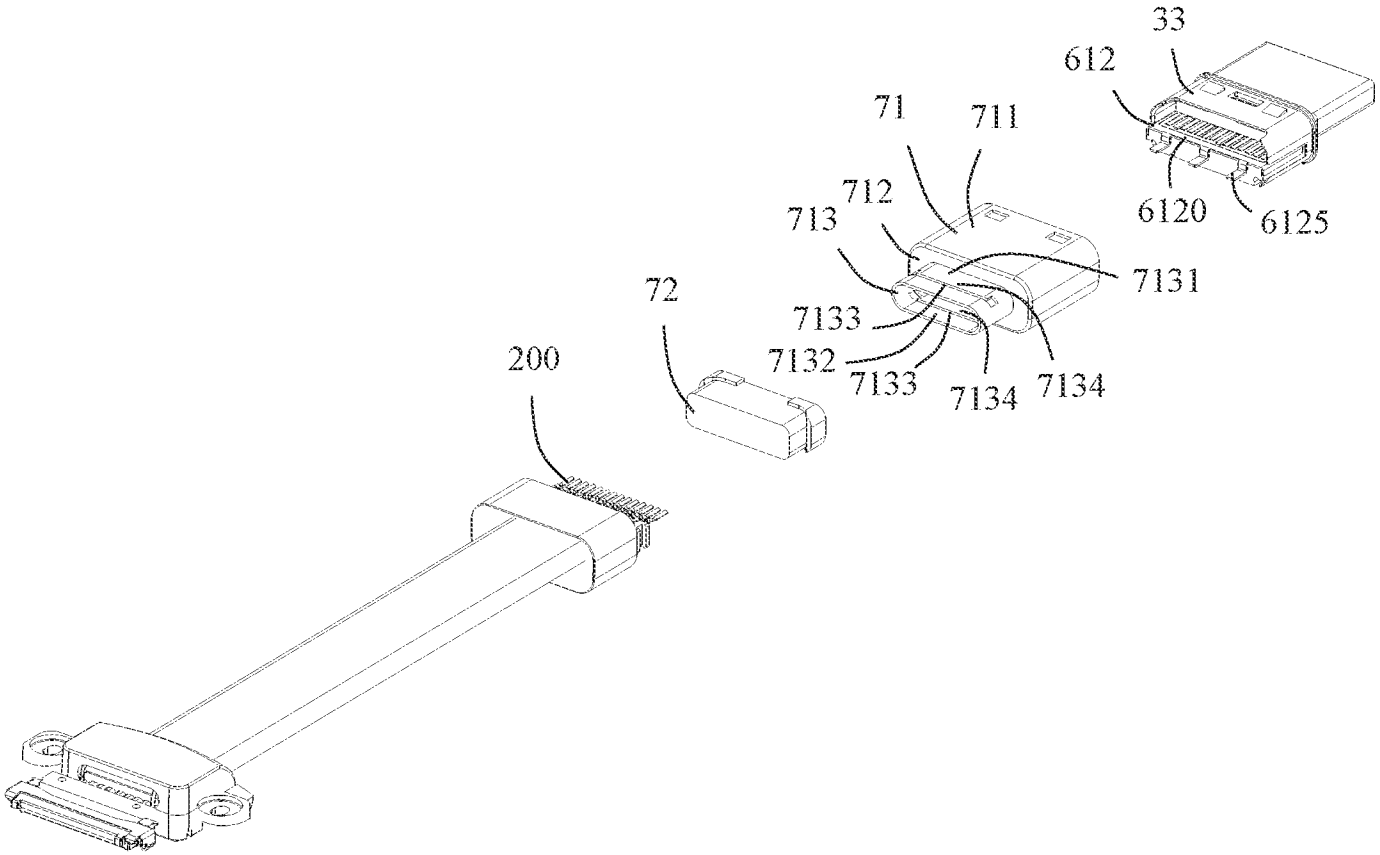
FIG. 23 is a partial perspective exploded view of the cable connector of the present disclosure after the outer housing is removed.
Figure 24:
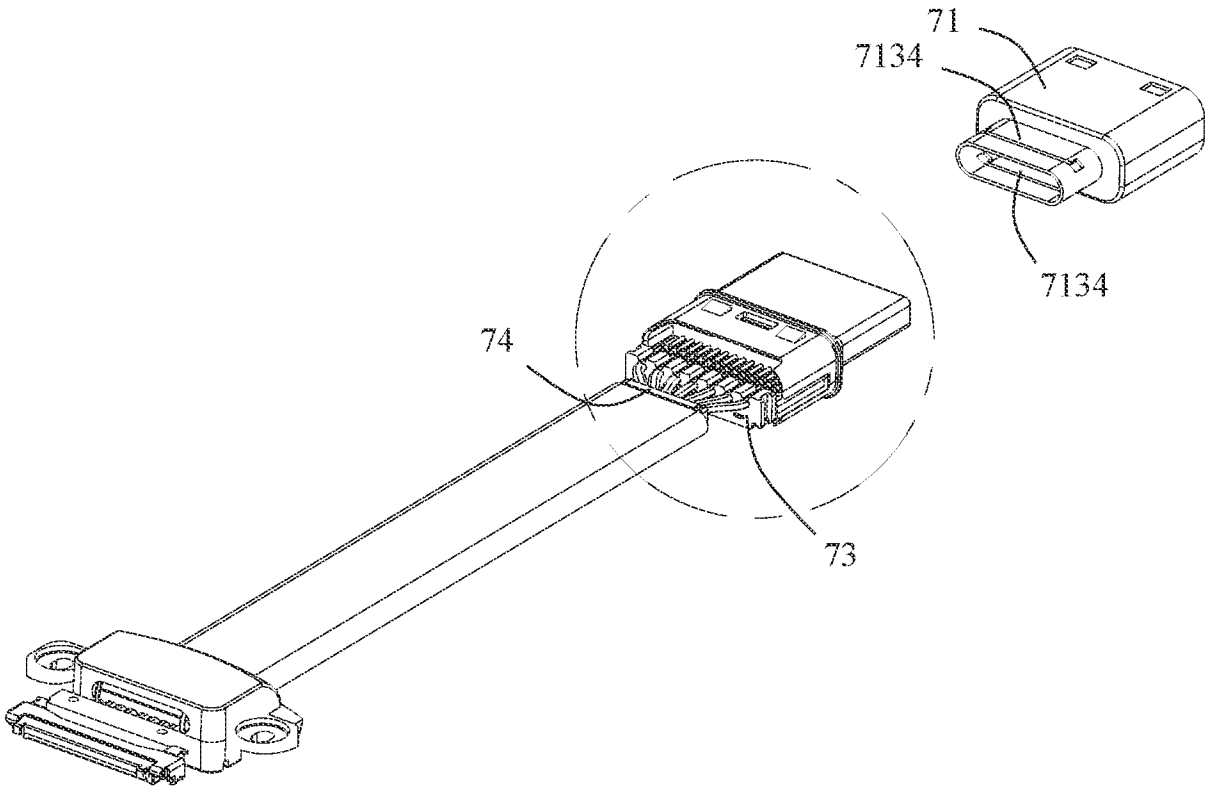
FIG. 24 is a schematic view of the cable connector of the present disclosure after the outer housing is removed and a second shielding shell is separated.

Referring to FIG. 18, the first tail portions 422 and the second tail portions 522 are interspersedly arranged in a row along the width direction W-W of the insulating body 1. Among the first tail portions 422 and the second tail portions 522 in the row, any two adjacent ones are two first tail portions 422, or two second tail portions 522, or one first tail portion 422 and one second tail portion 522. In other words, only the first tail portions 422 of the first conductive terminals 42 and the second tail portions 522 of the second conductive terminals 52 occupy the width of the raised platform 416 (that is, no other ground terminals occupy the width of the raised platform 416). With this arrangement, under the development trend that the conductive terminals of the electrical connector are becoming more and more dense, this design can more conveniently arrange the conductive terminals and reduce the risk of short circuits among the conductive terminals. In addition, this design can also simplify the design and manufacture of the conductive terminals, and reduce the increase in material cost and manufacturing cost caused by the continuous widening of the tail portions of the conductive terminals to both sides.

Figure 25:
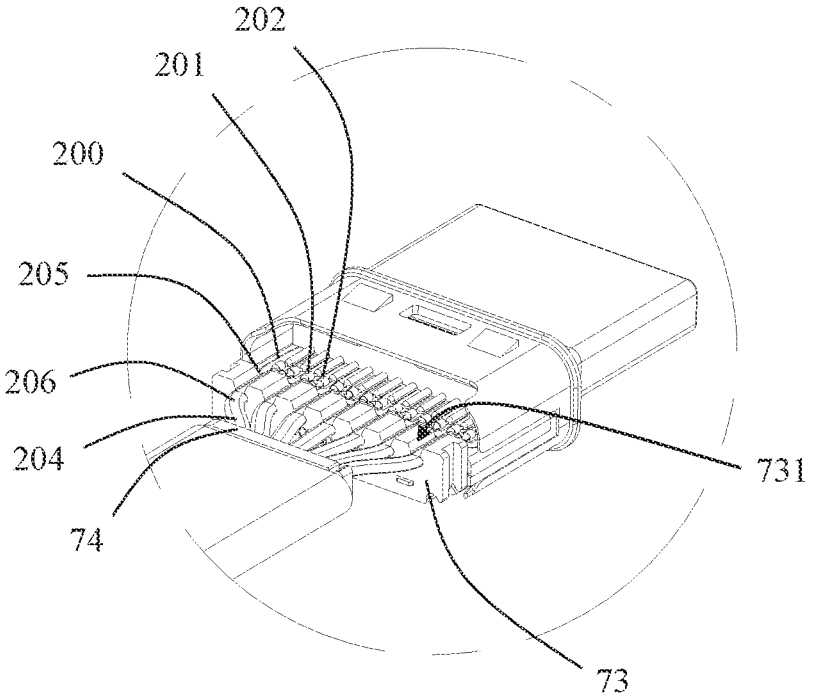
FIG. 25 is a partial enlarged view of a circled portion in FIG. 24.
Figure 26:
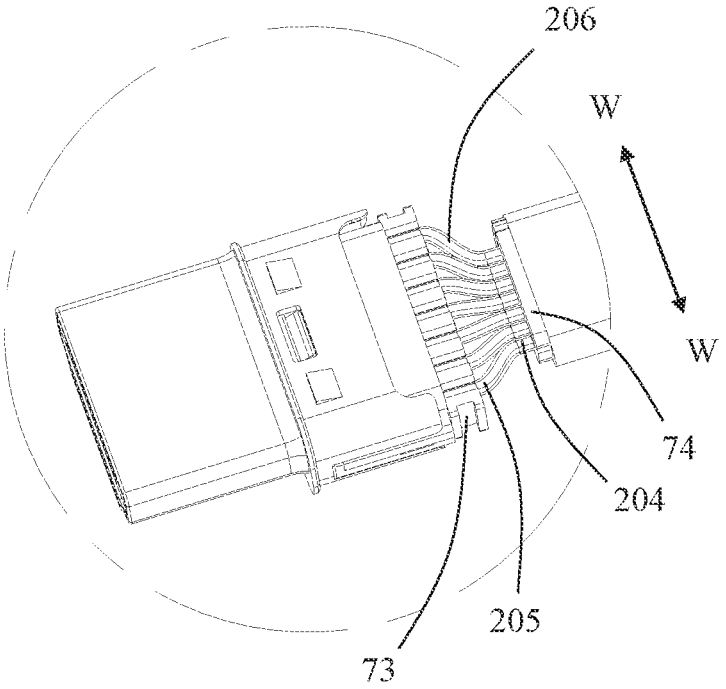
FIG. 26 is a partial enlarged view of FIG. 25 from another angle.

In an embodiment of the present disclosure, the first tail portions 422 are adapted to connect with first signal cables 201. The second tail portions 522 are adapted to connect with second signal cables 202. The frame 612 is adapted to connect with a cable grounding portion 203. In an embodiment of the present disclosure, the cable grounding portion 203 is formed by a grounding cable 2031 (as shown in FIG. 18). In another embodiment of the present disclosure, the cable grounding portion 203 is formed by the shielding layers 206 of the first signal cables 201 and the second signal cables 202 (as shown in FIGS. 25 and 26). In an embodiment of the present disclosure, the transverse wall 6120 is adapted to connect with the cable grounding portion 203. The cables 200 include the first signal cables 201, the second signal cables 202, and the ground cable 2031.

The present disclosure avoids problems such as poor contact caused by connecting various grounding terminals in series in the related art, by providing the integral shielding piece 6, which ensures the grounding reliability. In addition, the shielding piece 6 located between the first terminal module 4 and the second terminal module 5 greatly reduce the mutual interference of signals between the upper and lower layers when the first conductive terminal 42 and the second conductive terminal 52 are transmitting data, therefore it is beneficial to keep high-frequency and high-fidelity signal transmission. By arranging the first tail portions 422 and the second tail portions 522 in a single row, the connection to the cables can be completed by one soldering. As a result, it reduces the difficulty of soldering, improves the reliability of soldering and the stability of performance, and avoids the accumulation of defects due to multiple soldering. In addition, based on the soldering process used in this structure, it can be compatible with coaxial and twisted core wires at the same time, thereby expanding the scope of application.

Referring to FIGS. 19 to 24, another embodiment of the present disclosure discloses an electrical connector 400. The electrical connector 400 includes an electrical connector 100', a cable 200, and a cable connector 300. The electrical connector 100' and the cable connector 300 are connected at two ends of the cable 200, respectively.

The electrical connector 100' is basically the same as the electrical connector 100 shown in FIGS. 1 to 18. The difference is that the frame 612 of the electrical connector 100' also includes a plurality of L-shaped support portions 6125 extending from the transverse wall 6120 (referring to FIG. 23).

The electrical connector 400 further includes a second shielding shell 71 connected to the first shielding shell 3, a covering block 72 molded on the connection positions of the cable 200 and the first conductive terminals 42, the second conductive terminals 52 and the shielding piece 6, a conductive wire clamp 73 installed on the supporting portions 6125 and used to mate with the cable 200, a conductive element 74 installed on the cable 200, and an outer housing 75 over-molded on the electrical connector 100'. The outer housing 75 is made of an insulating material.

Referring to FIGS. 20 to 24, the second shielding shell 71 includes a cylindrical portion 711, an end wall 712 located at one end of the cylindrical portion 711, and an extension portion 713 integrally extending from the end wall 712 in a direction away from the cylindrical portion 711. The cylindrical portion 711 includes a first opening 7111 and a second opening 7112 which are mated with the first protrusion 3322 and the second protrusion 3312. The upper concept of the first opening 7111 and/or the second opening 7112 is an opening. Of course, in other embodiments, it is understandable to those skilled in the art that the position of the protrusion and the opening can also be exchanged. In the illustrated embodiment of the present disclosure, by locking the first shielding shell 3 and the second shielding shell 71, laser soldering can be used instead of solder during soldering. Therefore, efficiency is improved and the connection strength between the first shielding shell 3 and the second shielding shell 71 is enhanced.

During installation, the cylindrical portion 711 is sleeved on the retaining portion 33. The flange portion 31 can limit the installation of the cylindrical portion 711. The cylindrical portion 711 surrounds the circumference of the connection positions of the cable 200 with the first conductive terminals 42, the second conductive terminals 52 and the shielding piece 6, thereby playing a shielding role. The end wall 712 can partially close the internal space formed by the cylindrical portion 711, thereby improving the shielding effect.

The extension portion 713 is in a contracted shape compared to the cylindrical portion 711. The extension portion 713 has a hollow ring shape and includes a top surface 7131 and a bottom surface 7132 opposite to the top surface 7131. Each of the top surface 7131 and the bottom surface 7132 includes a slot 7133 located approximately in the middle and a crimping portion 7134 protruding into the slot 7133.

Figure 27:
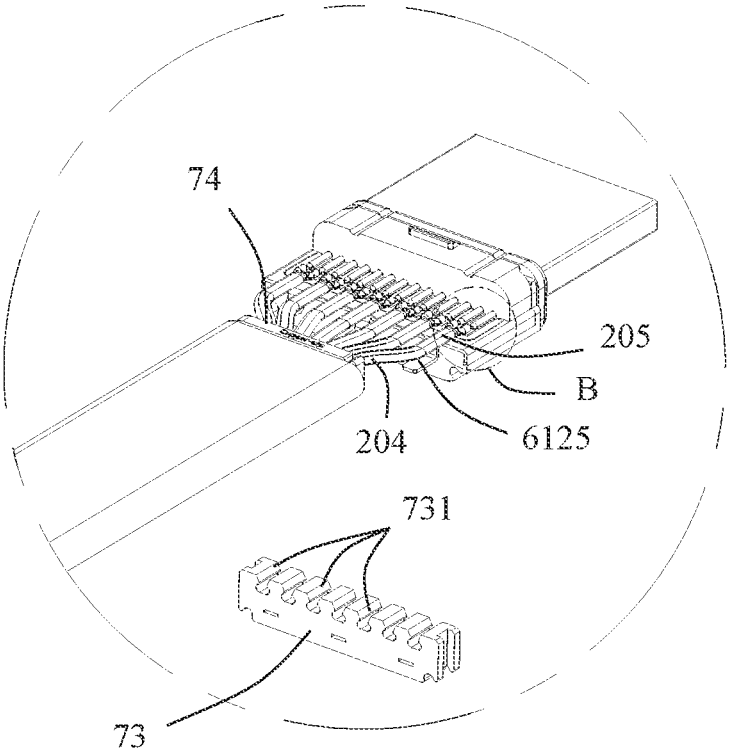
FIG. 27 is a partially exploded perspective view of FIG. 25, in which a conductive wire clamp is separated.

Referring to FIGS. 25 to 27, the cable 200 as a whole includes a first cable segment 204 and a second cable segment 205 extending from the first cable segment 204. A width of the first cable segment 204 along the width direction W-W of the insulating body 1 is different from a width of the second cable segment 205 along the width direction W-W of the insulating body 1. In the illustrated embodiment of the present disclosure, the cables of the first cable segment 204 are gathered along the width direction W-W of the insulating body 1. The cables of the second cable segment 205 are spread out along the width direction W-W of the insulating body 1. That is, the width of the first cable segment 204 in the width direction W-W of the insulating body 1 is smaller than the width of the second cable segment 205 in the width direction W-W of the insulating body 1. In the illustrated embodiment of the present disclosure, at the position where the first cable segment 204 is located, the cables are close to each other; and at the position where the second cable segment 205 is located, the cables are separated from each other. By providing the second cable segment 205, the distances between the cable 200 and the connection positions of the first conductive terminals 42, the second conductive terminals 52 and the shielding piece 6 are effectively increased, thereby avoiding short circuit. In addition, by increasing the distances, it is also beneficial for soldering, and improving the soldering quality and efficiency.

Figure 28:
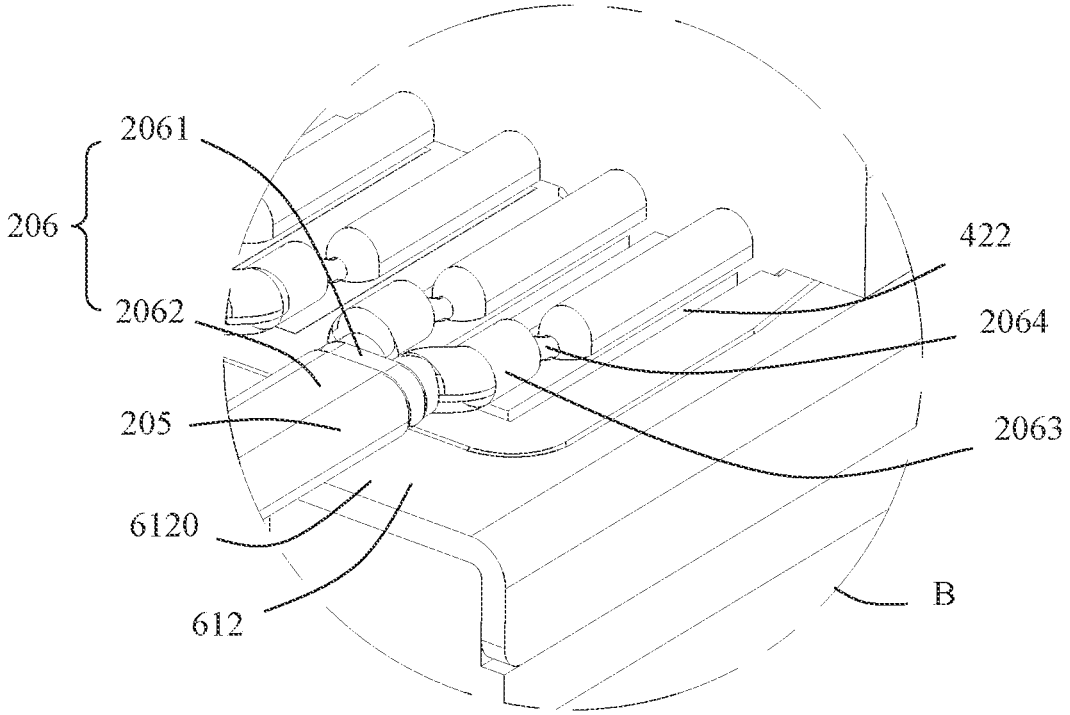
FIG. 28 is a partial enlarged view of a circled portion B in FIG. 27.
Figure 29:
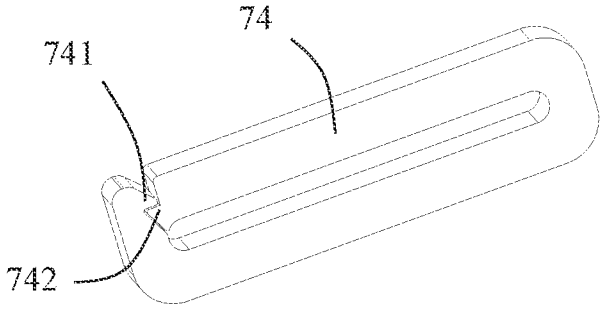
FIG. 29 is a perspective schematic view of a conductive element in FIG. 27.

The cable 200 includes a plurality of shielding layers 206. In the illustrated embodiment of the present disclosure, each shielding layer 206 is located on an outer layer of the cable 200. The conductive wire clamp 73 includes a plurality of positioning grooves 731 for supporting the second cable segment 205. The conductive wire clamp 73 is electrically connected to the shielding layers 206 and the shielding piece 6. This arrangement increases the shielding area and improves the shielding effect. Referring to FIG. 28, in the illustrated embodiment of the present disclosure, each shielding layer 206 has two layers, including an inner metal shielding layer 2061 and an outer metal shielding layer 2062. In an embodiment, the material of the inner metal shielding layer 2061 is aluminum. The material of the outer metal shielding layer 2062 is copper or other soft shielding materials. The inner metal shielding layer 2061 made of aluminum can achieve a better shielding effect. The cable 200 also includes a core wire 2064 for soldering with the first tail portion 422 of the first conductive terminal 42 or the second tail portion 522 of the second conductive terminal 52, and insulating layer 2063 wrapped on the core wire 2064. The shielding layer 206 is wrapped on the insulating layer 2063.

The conductive element 74 is installed on the first cable segment 204 and is electrically connected with the shielding layers 206 corresponding to the first cable segment 204. Referring to FIG. 37, the transverse wall 6120 of the frame 612 is electrically connected with the shielding layers 206 corresponding to the second cable segment 205. In an embodiment of the present disclosure, the conductive element 74 has a ring shape. The cable 200 passes through the conductive element 74. Referring to FIG. 38, the conductive element 74 is a ring formed by buckling, which improves the convenience to install it on the cable 200. The conductive element 74 includes a first fixing structure 741 and a second fixing structure 742. The first fixing structure 741 and the second fixing structure 742 can be buckled with each other in the height direction of the conductive element 74. In the illustrated embodiment of the present disclosure, the first fixing structure 741 is a hook. The second fixing structure 742 is a locking protrusion. The material of the conductive element 74 is at least one of a conductive metal (i.e., a conductive silver, a conductive copper, a conductive iron, a conductive steel), a conductive plastic, a conductive graphene, a conductive cloth, a conductive glue, and a conductive foam. The conductive element 74 has a certain deformability. The crimping portion 7134 of the second shielding shell 71 presses against the conductive element 74. In an embodiment of the present disclosure, the crimping portion 7134 of the second shielding shell 71 presses against the conductive element 74 by means of riveting. During riveting, the slot 7133 can provide a better deformation space for the crimping portion 7134, so as to easily and reliably press the crimping portion 7134 against the conductive element 74, and avoid damage to other structures of the second shielding shell 71. After the riveting is completed, the second shielding shell 71, the conductive element 74 and the shielding layers 206 of the cable 200 are tightly connected together, thereby achieving a better shielding protection effect.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector, comprising:

an insulating body, the insulating body comprising a mating surface, a mating slot extending through the mating surface, a mounting surface opposite to the mating surface, and an installation space extending through the mounting surface;

a terminal module, the terminal module being at least partially installed in the insulating body; and a first shielding shell, the first shielding shell enclosing the insulating body;

wherein the terminal module comprises a first terminal module, a second terminal module, and a shielding piece at least partially clamped between the first terminal module and the second terminal module;

wherein the first terminal module comprises a first insulating block and a plurality of first conductive terminals fixed to the first insulating block, each first conductive terminal comprises a first elastic contact arm extending into the mating slot and a first tail portion disposed opposite to the first elastic contact arm;

wherein the second terminal module comprises a second insulating block and a plurality of second conductive terminals fixed to the second insulating block, each second conductive terminal comprises a second elastic contact arm extending into the mating slot and a second tail portion disposed opposite to the second elastic contact arm;

wherein the shielding piece comprises a connecting portion between the plurality of first conductive terminals and the plurality of second conductive terminals, and a plurality of ground terminals extending from the connecting portion; the ground terminals comprise a plurality of first ground elastic arms arranged in a same row as the first elastic contact arms and a plurality of second ground elastic arms arranged in a same row as the second elastic contact arms; and wherein the first insulating block comprises an assembly surface, the first tail portions and the second tail portions are exposed on the assembly surface; the first insulating block comprises a raised platform on which the assembly surface is formed; the connecting portion comprises an opening to receive the raised platform and a frame surrounding the opening.

2. The electrical connector according to claim 1, wherein the first tail portions and the second tail portions are interspersedly arranged along a width direction of the insulating body in a row.

3. The electrical connector according to claim 2, wherein among the first tail portions and the second tail portions in the row, any two adjacent ones are two first tail portions, or two second tail portions, or one first tail portion and one second tail portion.

4. The electrical connector according to claim 2, wherein the raised platform comprises a plurality of receiving grooves recessed from the assembly surface, and the second tail portions extend beyond the second insulating block and are received in the receiving grooves.

5. The electrical connector according to claim 1, further comprising a second shielding shell locked with the first shielding shell, wherein one of the first shielding shell and the second shielding shell comprises a protrusion, and the other of the first shielding shell and the second shielding shell defines an opening to lock with the protrusion.

6. The electrical connector according to claim 1, wherein the first insulating block comprises a first supporting protrusion, the first supporting protrusion comprises a first supporting inclined surface; the second insulating block comprises a second supporting protrusion, the second supporting protrusion comprises a second supporting inclined surface; each first ground elastic arm comprises a first inclined root portion connected to the connecting portion, the first inclined root portion is supported on the second supporting inclined surface; each second ground elastic arm comprises a second inclined root portion connected to the connecting portion, and the second inclined root portion is supported on the first supporting inclined surface.

7. The electrical connector according to claim 1, wherein the first insulating block and the second insulating block comprise mutually locking structures so that at least a part of the connecting portion is clamped between the first insulating block and the second insulating block.

8. The electrical connector according to claim 1, wherein the shielding piece is made of a metal material and has a one-piece structure.

9. The electrical connector according to claim 1, wherein none of the plurality of first conductive terminals and the plurality of second conductive terminals comprises a terminal with grounding function.

10. An electrical connector, comprising:

an insulating body, the insulating body comprising a mating surface, a mating slot extending through the mating surface, a mounting surface opposite to the mating surface, and an installation space extending through the mounting surface;

a terminal module, the terminal module being at least partially installed in the insulating body; and a first shielding shell, the first shielding shell enclosing the insulating body;

wherein the terminal module comprises a first terminal module, a second terminal module, and a shielding piece at least partially clamped between the first terminal module and the second terminal module;

wherein the first terminal module comprises a first insulating block and a plurality of first conductive terminals fixed to the first insulating block, each first conductive terminal comprises a first elastic contact arm extending into the mating slot and a first tail portion disposed opposite to the first elastic contact arm;

wherein the second terminal module comprises a second insulating block and a plurality of second conductive terminals fixed to the second insulating block, each second conductive terminal comprises a second elastic contact arm extending into the mating slot and a second tail portion disposed opposite to the second elastic contact arm;

wherein the shielding piece comprises a connecting portion between the plurality of first conductive terminals and the plurality of second conductive terminals, and a plurality of ground terminals extending from the connecting portion; the ground terminals comprise a plurality of first ground elastic arms arranged in a same row as the first elastic contact arms and a plurality of second ground elastic arms arranged in a same row as the second elastic contact arms; and wherein the connecting portion comprises an opening and a frame surrounding the opening; and wherein the first tail portions and the second tail portions are located in the opening and not in contact with the frame.

11. The electrical connector according to claim 10, wherein the first tail portions are adapted to connect with first signal cables, the second tail portions are adapted to connect with second signal cables, and the frame is adapted to connect with a cable grounding portion.

12. The electrical connector according to claim 11, wherein the frame comprises a first side wall, a second side wall parallel to the first side wall, and a transverse wall connecting the first side wall and the second side wall, and the transverse wall is adapted to connect with the cable grounding portion; and wherein the cable grounding portion is formed by a grounding cable; or the cable grounding portion is formed by shielding layers of the first signal cables and shielding layers of the second signal cables.

13. The electrical connector according to claim 12, wherein the first shielding shell comprises a first notch and a second notch located on two sides thereof, respectively; the first side wall is interference-fitted in the first notch so as to be electrically connected with the first shielding shell, and the second side wall is interference-fitted in the second notch so as to be electrically connected with the first shielding shell.

14. The electrical connector according to claim 10, wherein the first insulating block comprises an assembly surface and a raised platform on which the assembly surface is formed; and the raised platform is received in the opening of the connecting portion.

15. An electrical connector, comprising:

an insulating body, the insulating body comprising a mating surface, a mating slot extending through the mating surface, a mounting surface opposite to the mating surface, and an installation space extending through the mounting surface;

a terminal module, the terminal module being at least partially installed in the insulating body; and a first shielding shell, the first shielding shell enclosing the insulating body;

wherein the terminal module comprises a first terminal module, a second terminal module, and a shielding piece at least partially clamped between the first terminal module and the second terminal module;

wherein the first terminal module comprises a first insulating block and a plurality of first conductive terminals fixed to the first insulating block, each first conductive terminal comprises a first elastic contact arm extending into the mating slot and a first tail portion disposed opposite to the first elastic contact arm;

wherein the second terminal module comprises a second insulating block and a plurality of second conductive terminals fixed to the second insulating block, each second conductive terminal comprises a second elastic contact arm extending into the mating slot and a second tail portion disposed opposite to the second elastic contact arm;

wherein the shielding piece comprises a connecting portion between the plurality of first conductive terminals and the plurality of second conductive terminals, and a plurality of ground terminals extending from the connecting portion; the ground terminals comprise a plurality of first ground elastic arms arranged in a same row as the first elastic contact arms and a plurality of second ground elastic arms arranged in a same row as the second elastic contact arms;

wherein the electrical connector further comprises a plurality of cables connecting with the first conductive terminals, the second conductive terminals and the shielding piece; wherein each cable comprises a shielding layer; the electrical connector further comprises a conductive wire clamp electrically connected with the shielding layers, the conductive wire clamp defines a plurality of positioning grooves for positioning the cables, and the conductive wire clamp is electrically connected with the shielding piece; and wherein the shielding layer comprises an inner metal shielding layer and an outer metal shielding layer wrapped on the inner metal shielding layer.

16. The electrical connector according to claim 15, wherein the cables as a whole comprise a first cable segment and a second cable segment extending from the first cable segment, a width of the first cable segment along a width direction of the insulating body is smaller than a width of the second cable segment along the width direction of the insulating body, and the second cable segment is positioned in the positioning grooves.

17. The electrical connector according to claim 16, further comprising a conductive element mounted on the first cable segment, and the conductive element is electrically connected with the shielding layers corresponding to the first cable segment; and wherein the electrical connector comprises a second shielding shell connected to the first shielding shell, and the second shielding shell comprises a crimping portion pressing against the conductive element.

18. The electrical connector according to claim 17, wherein the connecting portion comprises an opening and a frame surrounding the opening, the first tail portions and the second tail portions are located in the opening and not in contact with the frame, and the frame is electrically connected with the shielding layers corresponding to the second cable segment.

19. The electrical connector according to claim 17, wherein material of the conductive element is at least one of a conductive metal, a conductive plastic, a conductive graphene, a conductive cloth, a conductive glue and a conductive foam.

20. The electrical connector according to claim 15, wherein the first insulating block comprises an assembly surface and a raised platform on which the assembly surface is formed; the first tail portions and the second tail portions are exposed on the assembly surface; and the raised platform is received in the opening of the connecting portion.

* * * * *